US010161715B2

(12) United States Patent
Nelson

(10) Patent No.: US 10,161,715 B2
(45) Date of Patent: Dec. 25, 2018

(54) GUN HOLSTER TRANSPORT SYSTEM

(71) Applicant: Gould & Goodrich, Inc., Lillington, NC (US)

(72) Inventor: Scott Gilbert Nelson, Raleigh, NC (US)

(73) Assignee: POINT BLANK ENTERPRISES, INC., Pompano Beach, FL (US)

( * ) Notice: Subject to any disclaimer, the term of this patent is extended or adjusted under 35 U.S.C. 154(b) by 0 days.

(21) Appl. No.: 15/438,409

(22) Filed: Feb. 21, 2017

(65) Prior Publication Data

US 2017/0241740 A1 Aug. 24, 2017

Related U.S. Application Data

(60) Provisional application No. 62/297,456, filed on Feb. 19, 2016.

(51) Int. Cl.
*F41C 33/02* (2006.01)

(52) U.S. Cl.
CPC ..... *F41C 33/0227* (2013.01); *F41C 33/0263* (2013.01)

(58) Field of Classification Search
CPC ..... F41C 33/0227; F41C 33/046; F41C 33/0236; F41C 33/0245; F41C 33/0263; F41C 33/0209; F41C 33/041; F41C 33/048; F41C 33/02; F41C 33/0218; Y10S 224/911; Y10S 224/912
USPC ..... 224/911–912, 677, 242–243
See application file for complete search history.

(56) References Cited

U.S. PATENT DOCUMENTS 3,010,169 A * 11/1961 Carpinella ..... A44B 17/00 24/107
5,820,003 A * 10/1998 Nichols ..... F41C 33/0227 224/192

* cited by examiner

*Primary Examiner* — Adam Waggenspack
(74) *Attorney, Agent, or Firm* — Jenkins, Wilson, Taylor & Hunt, P.A.

(57) ABSTRACT

The subject matter described herein includes a gun holster transport system. The gun holster transport system comprises a wrapping member for wrapping at least partially around itself to form an aperture for receiving a barrel holding portion of a gun holster. The wrapping member forms first and second arms extending axially from the barrel holding portion and which are positionable on opposite sides of a butt of a gun. The first and second arms each form lock-receiving apertures for receiving a lock positionable behind the butt of the gun to prevent withdraw of the gun from the gun holster.

9 Claims, 8 Drawing Sheets

GUN HOLSTER TRANSPORT SYSTEM

PRIORITY CLAIM

This application claims the priority benefit of U.S. Provisional Patent Application No. 62/297,456 filed Feb. 19, 2016, the disclosure of which is incorporated herein by reference in its entirety.

TECHNICAL FIELD

The subject matter described herein relates to gun holster transport systems.

BACKGROUND

In some instances, it is desirable for gun holsters to be locked to prevent withdraw of the firearm from the holster. One such instance is in support of air travel, where travelers would benefit from a lightweight and secure means of transporting a holstered pistol. Current transport systems are often bulky, heavy, and expensive. Another instance in which it may be desirable to lock a gun in a holster is in a home or business to prevent unauthorized access to the gun. While no mechanism can indefinitely prevent access to a firearm, it may be desirable to provide a transport system that is tamper resistant, light weight, easy to manufacture, and easy to use.

Accordingly, there exists a need for an improved gun holster transport system.

SUMMARY

The subject matter described herein includes a gun holster transport system. The gun holster transport system comprises a wrapping member for wrapping at least partially around itself to form an aperture for receiving a barrel holding portion of a gun holster. The wrapping member forms first and second arms extending axially from the barrel holding portion and which are positionable on opposite sides of a butt of a gun. The first and second arms each form lock-receiving apertures for receiving a lock positionable behind the butt of the gun to prevent withdraw of the gun from the gun holster.

A method for manufacturing a gun holster transport system includes forming a wrapping member of a malleable material. The method further includes forming first and second lock receiving apertures in first and second arms of the wrapping member. The method further includes wrapping the wrapping member around a model to form a first aperture for receiving a barrel holding portion of a gun holster. The method further includes twisting the first arm such that the apertures align on opposite sides of a gun butt portion of the model. The method further includes removing the model and fastening the wrapping member to itself.

BRIEF DESCRIPTION OF THE DRAWINGS

The subject matter described herein will now be explained with reference to the accompanying drawings of which.

DETAILED DESCRIPTION

Figure 1:
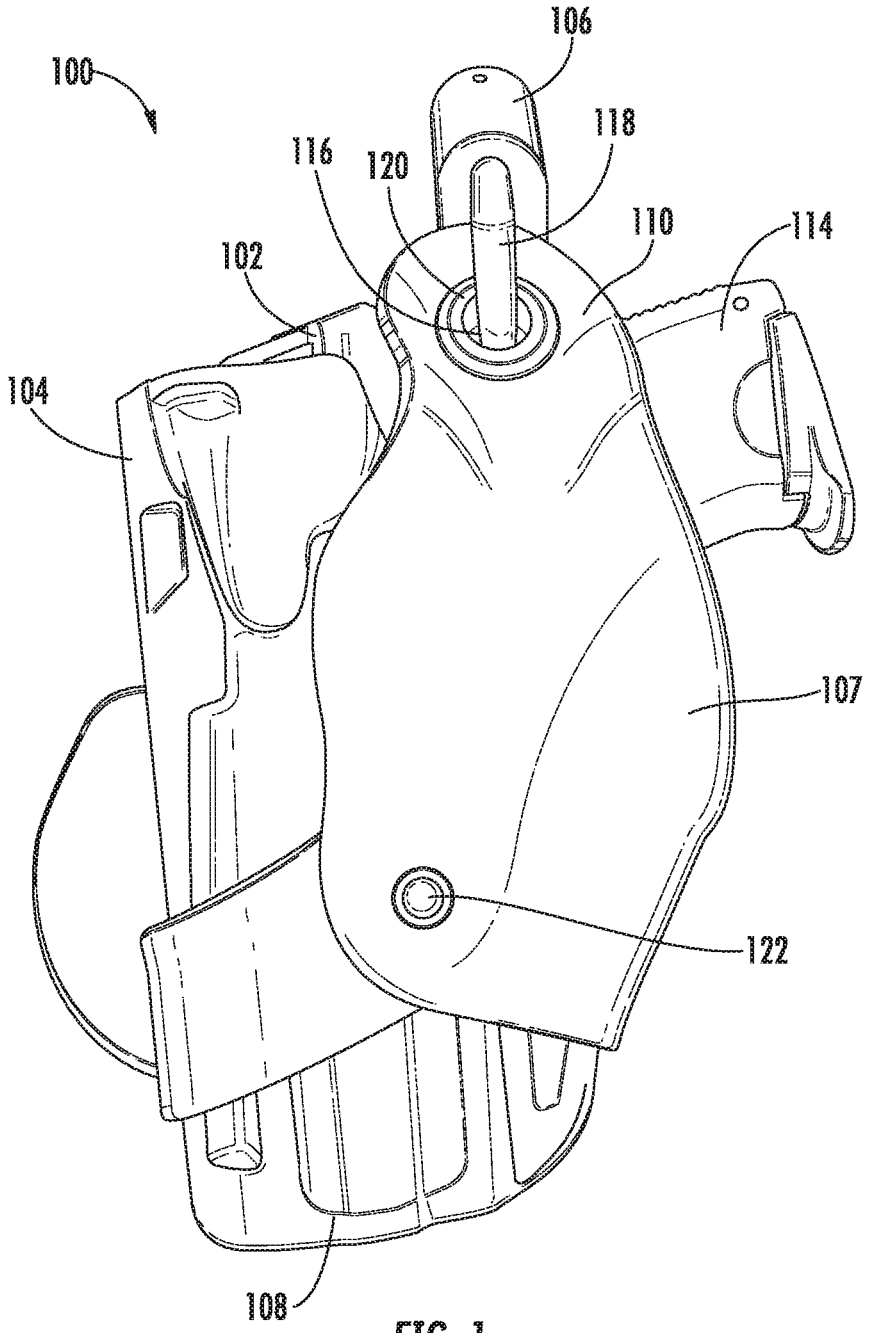
FIG. 1 is a left side view of a gun holster transport system holding a gun and a holster with a lock locking the gun and the holster in the gun holster transport system according to an embodiment of the subject matter described herein.
Figure 2:
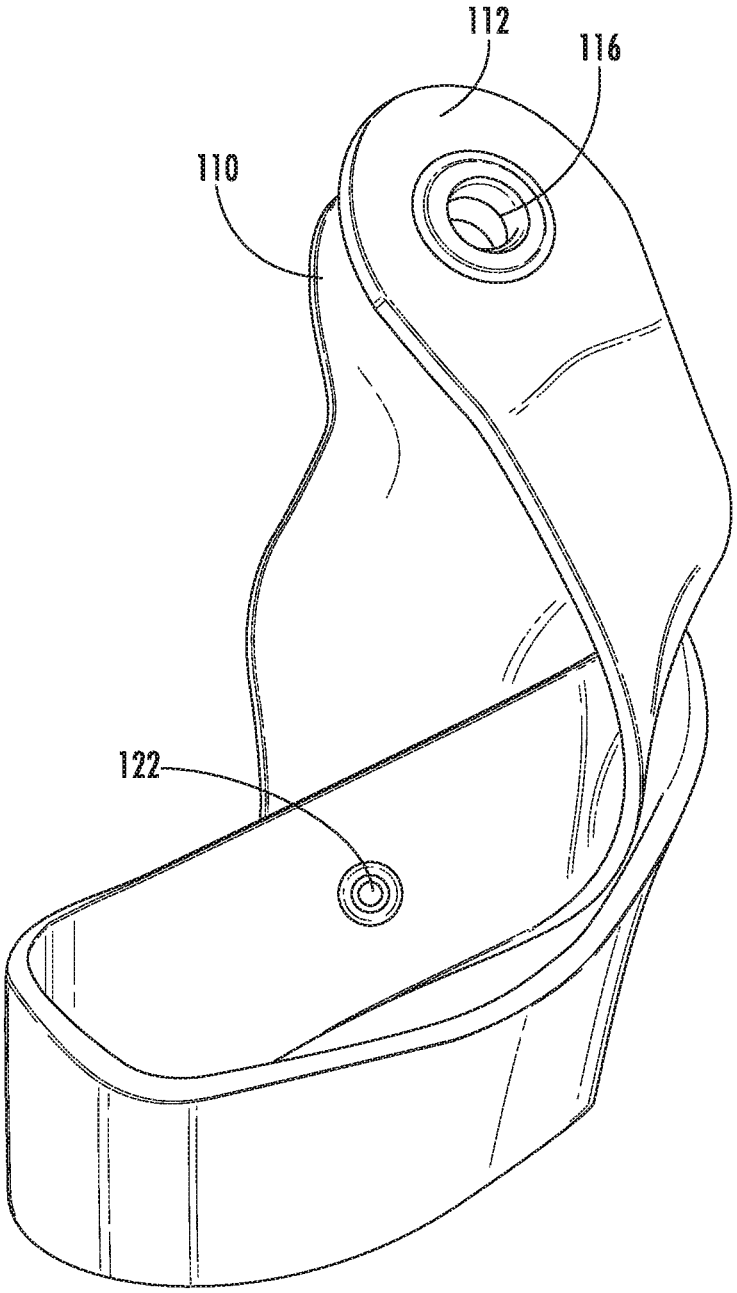
FIG. 2 is a right side view of a gun holster transport system according to an embodiment of the subject matter described herein.

FIG. 1 is a left side view of a gun holster transport system holding a gun in a gun holster locked in the gun holster transport system according to an embodiment of the subject matter described herein. Referring to FIG. 1, a gun holster transport system 100 holds a gun 102 inside of a gun holster 104 and also receives a lock 106 to prevent withdraw of gun 102 from gun holster 104 by locking gun 102 and holster 104 within transport system 100. In the illustrated example, gun holster transport system 100 includes a wrapping member 107 that wraps at least partially around itself to receive a barrel holding portion 108 of gun holster 104. Wrapping member 107 also forms first and second arms 110 and 112, more easily viewable in FIG. 2, which are positionable on opposite sides of a butt portion 114 of gun 102. As illustrated in FIG. 2, arms 110 and 112 (shown in FIG. 2) form apertures 116 for receiving shackle 118 of lock 106. When shackle 118 of lock 106 is positioned through apertures 116 and locked, gun 102 cannot be withdrawn from holster 104 without requiring significant time to destroy gun holster transport system 100. To reinforce apertures 116, gun holster transport system 100 includes grommets 120. Gun holster transport system 100 further includes a rivet 122 or other mechanism for holding the shape of wrapping member 107 and increasing its tamper resistance. In the right side view in FIG. 3, arm 110, aperture 116, and grommet 120 are illustrated.

Figure 3:
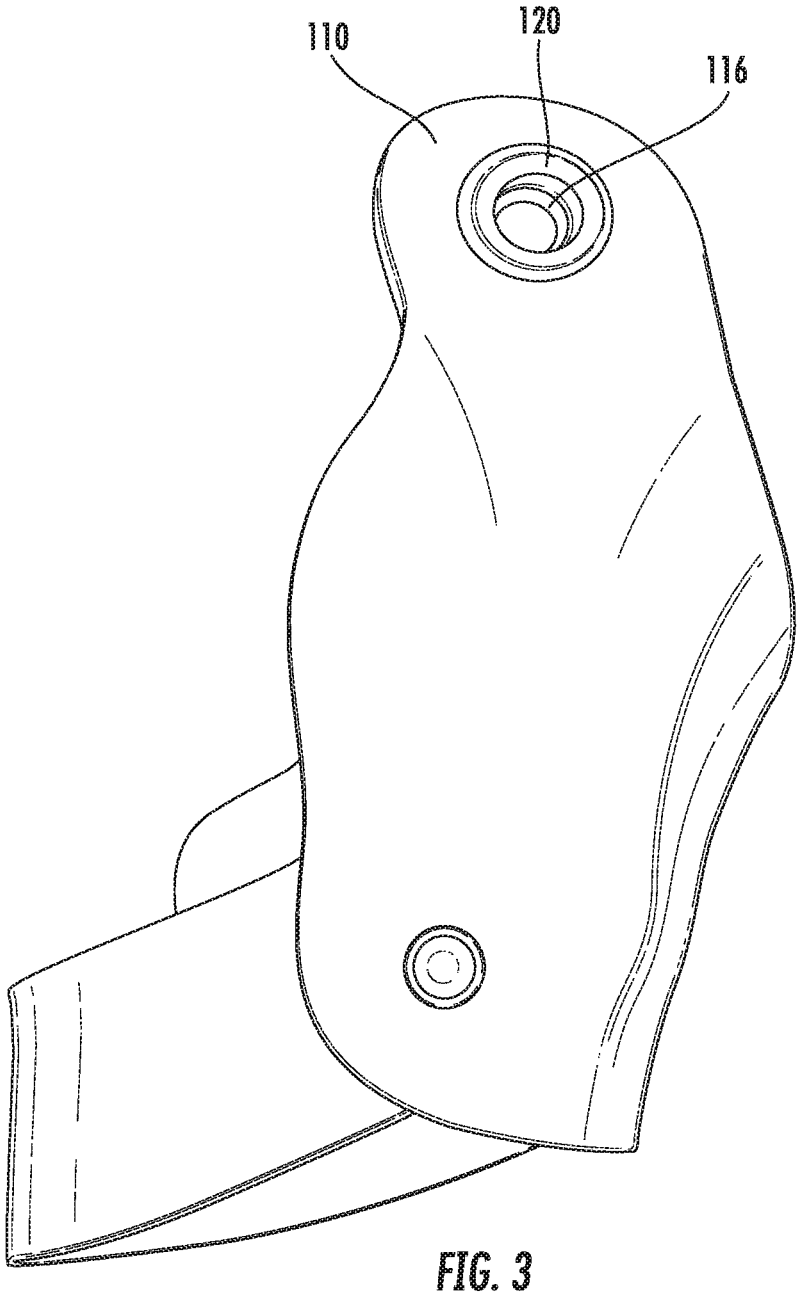
FIG. 3 is a left side view of a gun holster transport system according to an embodiment of the subject matter described herein.

FIGS. 2 and 3 are left and right side views, respectively, of gun holster transport system 100 without a gun and a holster. In FIG. 2, arms 110 and 112 comprise flexible members that are bendable towards or away from each other to accommodate guns and gun holsters of different sizes. When arms 110 and 112 are brought in close proximity to each other and a lock is inserted into apertures 116, a barrier is formed that prevents withdrawal of a gun from its holster and the gun and the holster from gun holster transport system 100.

Figure 4:
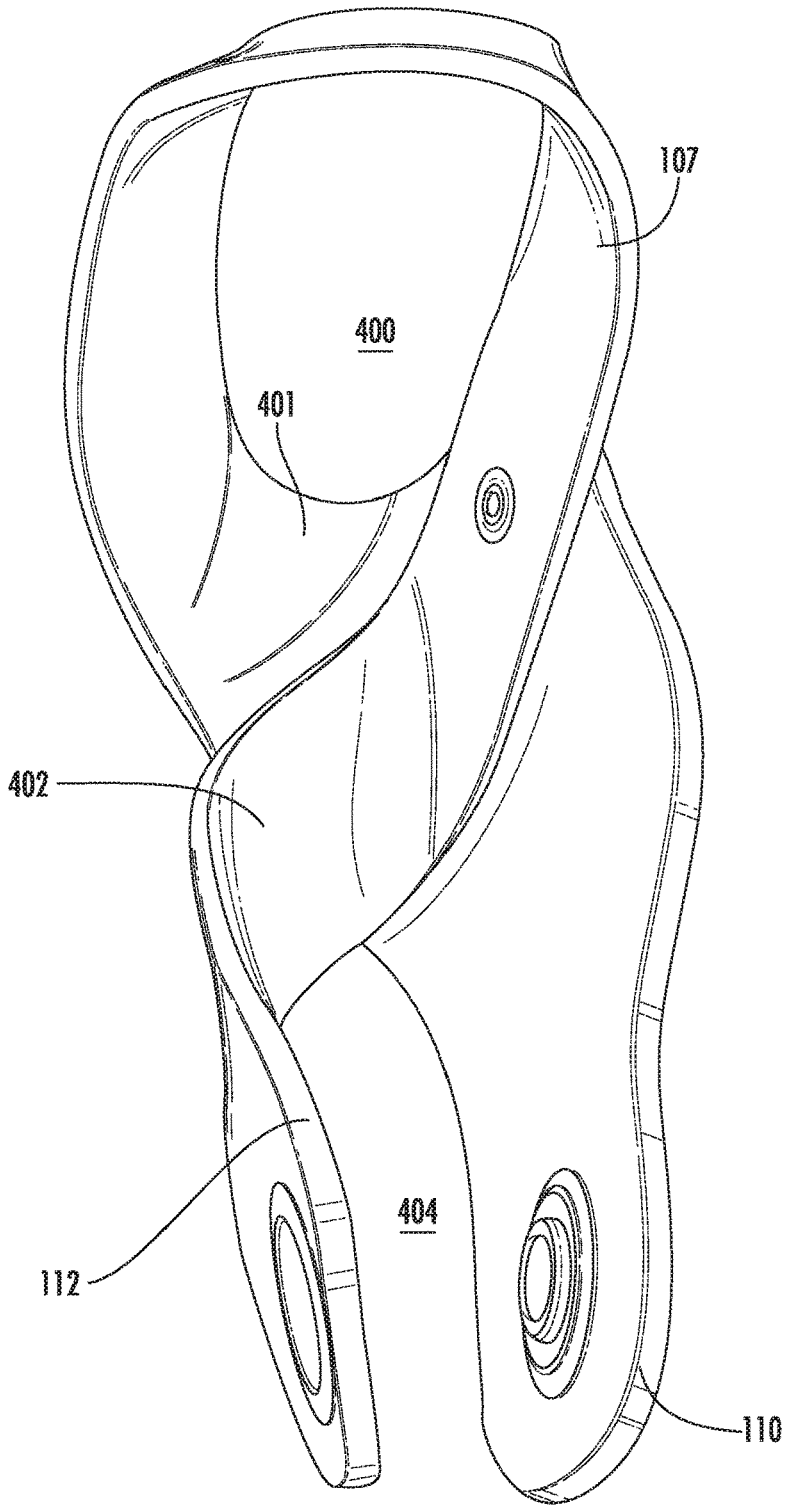
FIG. 4 is top axial view of a gun holster transport system according to an embodiment of the subject matter described herein.
Figure 5:
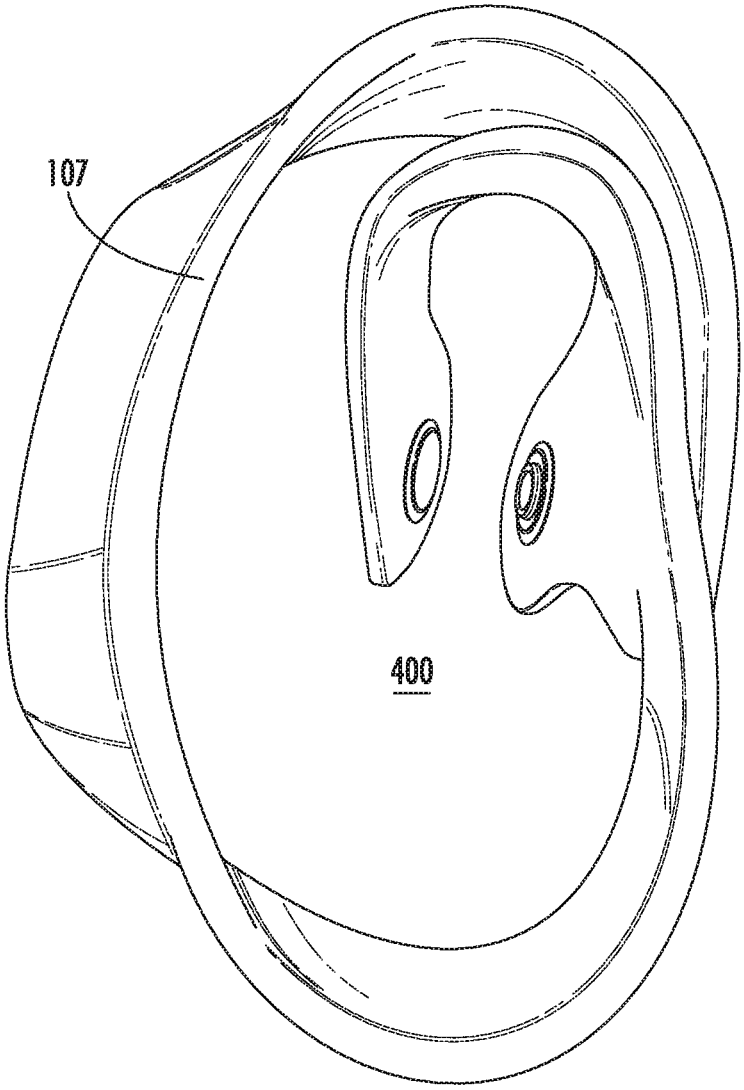
FIG. 5 is a bottom axial view of a gun holster transport system according to an embodiment of the subject matter described herein.

As illustrated in FIG. 4, wrapping member 107 forms aperture 400 for receiving barrel holding portion 108 of a gun holster (illustrated in FIG. 1). In addition, arms 110 and 112 extend axially from aperture 400 and are positionable on opposite sides of butt 114 of firearm or gun 102. Arm 110 includes a 180° bend 401, and arm 112 includes a 180° bend or twist 402 so that arm 112 is separated from and positionable on the opposite side of butt 114 from arm 110. As such, arm 112 forms a spiral structure extending axially from aperture 400. FIG. 5 illustrates aperture 400 from the bottom. In FIG. 5, it can be seen that aperture 400 is formed by wrapping wrapping member 107 at least partially around itself and that wrapping member 107 comprises a unitary member formed of a single piece.

Figure 6:
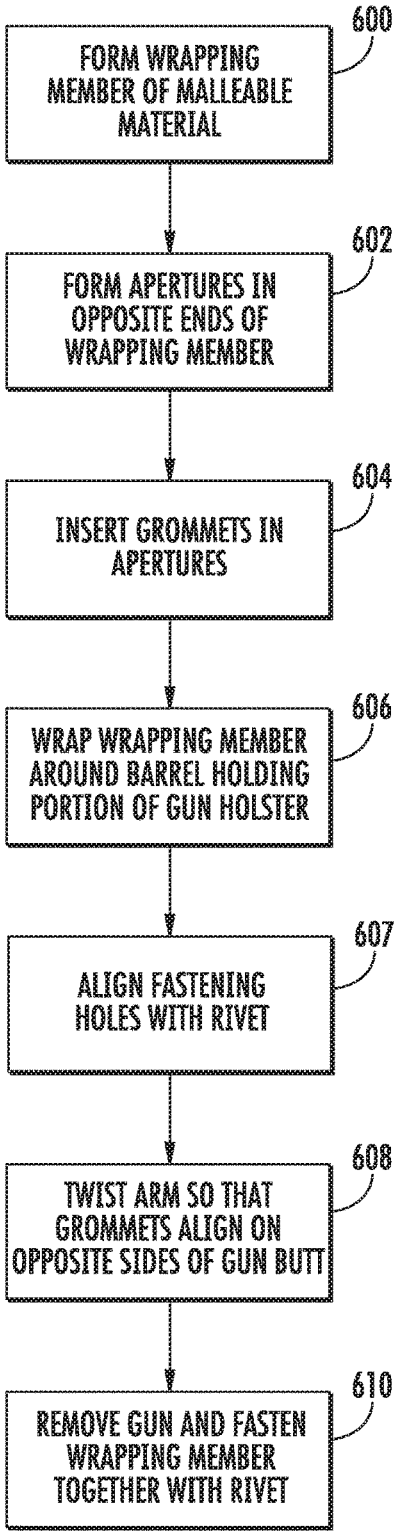
FIG. 6 is a flow chart illustrating exemplary steps of a process for manufacturing a gun holster transport system according to an embodiment of the subject matter described herein.

The gun holster transport system illustrated in FIGS. 1 through 5 is lightweight and easy to manufacture. FIG. 6 is a flow chart illustrating an exemplary process for manufacturing a gun holster transport system according to an embodiment of the subject matter described herein. Referring to FIG. 6, in step 600, a wrapping member is formed of a malleable material. For example, wrapping member 107 may be formed of a malleable material, such as a thermal formed plastic material that is malleable when heated to a certain temperature. In step 602, apertures are formed in opposite ends of the malleable material. For example, apertures 116 may be formed (i.e., cut, punched, or molded) in opposite ends of wrapping member 107. Grommets 120 may be inserted in apertures 116 to increase the tamper resistance of gun holster transport system 100. Alternatively, grommets 120 may be omitted if the material used to make wrapping member 107 is sufficiently strong. Grommets 120 may also make it easier to insert shackle 118 of lock 106 by providing edges along the inner diameters of grommets 118 that are rounded and less sharp than the inner edges in the thermal formed plastic material that forms apertures 116.

In step 606, the wrapping member is wrapped around the barrel holding portion of a gun holster. For example, wrapping member 107 may be wrapped around barrel holding portion 108 of gun holster 104. If wrapping member 107 is formed using a thermal plastic material, heat may be applied before wrapping the wrapping member around a gun holster, a gun and gun holster, or a gun and gun holster model.

Figure 7:
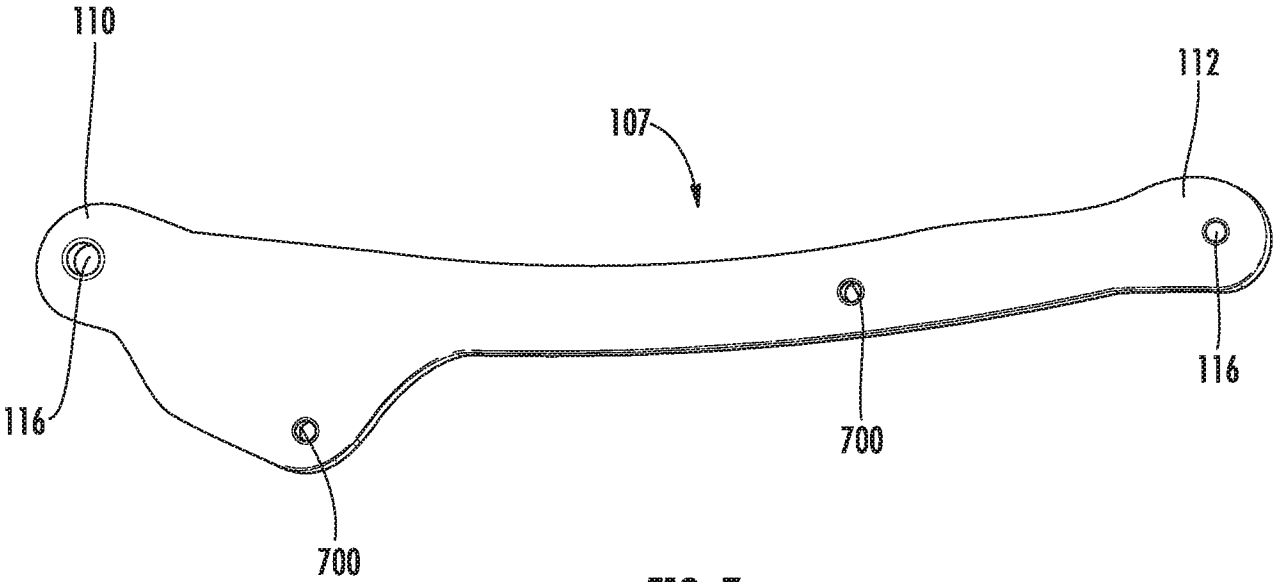
FIG. 7 is a plan view of a wrapping member for forming a gun holster transport system according to an embodiment of the subject matter described herein.
Figure 8:
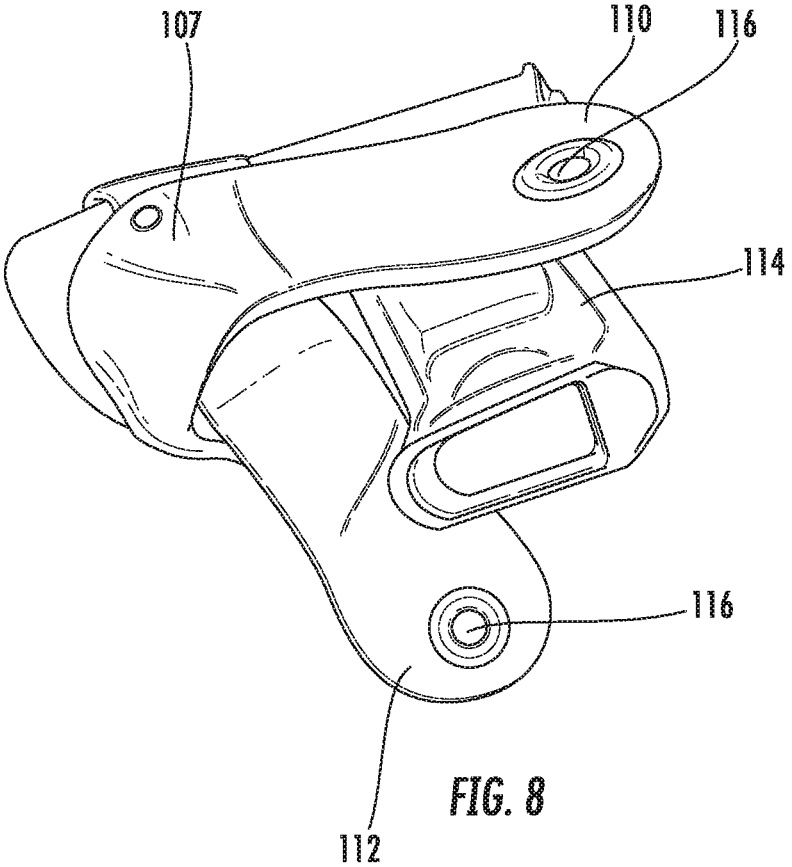
FIG. 8 is a side view illustrating the wrapping of a wrapping member around a gun during manufacturing according to an embodiment of the subject matter described herein.

In step 607, fastening holes are aligned using a rivet. For example, referring to FIGS. 7 and 8, wrapping member may include fastening holes 700 that are aligned and held together using a rivet when holes 700 are aligned with each other. The rivet may be inserted in one of holes 700 when wrapping member is substantially flat, as illustrated in FIG. 7. When wrapping member is wrapped around the barrel of a gun or gun model, the rivet may be inserted through the corresponding fastening hole 700 to hold wrapping member around the gun barrel.

In step 608, arm 112 is twisted so that grommets 116 align on opposite sides of the gun butt. For example, in FIG. 8, arm 112 may be twisted 180 degrees so that grommets 116 align on opposite sides of gun butt 114.

In step 610, the gun is removed from the wrapping member, and the wrapping member is fastened together with the rivet that was used to align fastening holes 700. It should be noted that in one exemplary manufacturing method, different gun and holster blanks may be used for forming wrapping member 107 into desired shapes for different sizes and shapes of firearms. Exemplary characteristics of a blank may include that it is larger in volume than the gun and holster model for which it is designed and includes rounded outer surfaces to provide rounded inner edges once wrapping member is formed into the desired shape. For example, for the gun and holster illustrated in FIG. 1, a blank that fills the interior region of wrapping member 107 illustrated in FIGS. 4 and 5 may be used.

It will be understood that various details of the presently disclosed subject matter may be changed without departing from the scope of the presently disclosed subject matter. Furthermore, the foregoing description is for the purpose of illustration only, and not for the purpose of limitation.

What is claimed is:

1. A gun holster transport system comprising:

a wrapping member comprising a unitary elongate member having a first surface for facing a gun holster, a second surface opposite the first surface for facing away from the gun holster, a first arm, and a second arm, wherein the first arm passes under and is attached to the second arm to form a loop for receiving a barrel holding portion of a gun holster, wherein the first surface of the unitary elongate member contacts and faces the second surface of the unitary elongate member at a location where the first arm attaches to the second arm;

the first and second arms extending axially from the barrel holding portion and positionable on opposite sides of a gun butt, wherein the second arm includes a twist after the location where the first arm attaches to the second arm and the twist rotates the first surface of the elongate member at an end of the second arm to face the first surface of the elongate member at an end of the first arm; and the first and second arms each including a lock receiving aperture for receiving a lock for locking the gun in the gun holster.

2. The gun holster transport system of claim 1 wherein the wrapping member is formed of a single piece.

3. The system of claim 1 wherein the wrapping member is formed of a malleable material.

4. The gun holster transport system of claim 3 wherein the malleable material comprises a thermal formed plastic material.

5. The system of claim 1 wherein the first and second arms each include bends of 180 degrees.

6. The gun holster transport system of claim 1 comprising first and second grommets located in the lock receiving apertures.

7. The gun holster transport system of claim 1 comprising a rivet located in the wrapping member for fastening the first arm to the second arm.

8. The gun holster transport system of claim 1 wherein the first and second arms each comprise flexible members that are bendable toward and away from each other to hold guns and gun holsters of different sizes.

9. The gun holder transport system of claim 8 wherein the first and second arms form an aperture for receiving the gun butt.

* * * * *